US005444036A

United States Patent [19]

Iwasaki et al.

[11] Patent Number: 5,444,036

[45] Date of Patent: * Aug. 22, 1995

[54] THERMOSENSITIVE RECORDING MATERIAL

[75] Inventors: Akiko Iwasaki, Urawa; Kunitaka Toyofuku, Sakura; Kyoko Uchida, Machida; Masatoshi Fujino, Tokyo, all of Japan

[73] Assignee: New Oil Paper Co., Ltd., Tokyo, Japan

[ * ] Notice: The portion of the term of this patent subsequent to Sep. 21, 2010 has been disclaimed.

[21] Appl. No.: 178,830

[22] Filed: Jan. 7, 1994

[30] Foreign Application Priority Data

Jan. 8, 1993 [JP] Japan ..... 5-002000

[51] Int. Cl.[6] ..... B41M 5/30

[52] U.S. Cl. ..... 503/209; 427/150; 503/208; 503/216; 503/225

[58] Field of Search ..... 427/150; 503/208, 209, 503/216, 225

[56] References Cited

U.S. PATENT DOCUMENTS

| | | | |
|---|---|---|---|
| 3,539,375 | 11/1970 | Baum | 503/214 |
| 5,246,906 | 9/1993 | Takahashi et al. | 503/209 |
| 5,292,711 | 3/1994 | Nishimura et al. | 503/209 |
| 5,314,859 | 5/1994 | Takahashi et al. | 503/207 |

FOREIGN PATENT DOCUMENTS

| | | |
|---|---|---|
| 0104353 | 4/1984 | European Pat. Off. . |
| 0512560 | 11/1992 | European Pat. Off. . |
| 434160 | 2/1968 | Japan . |
| 4514039 | 5/1970 | Japan . |
| 4827736 | 4/1973 | Japan . |
| 56-146794 | 11/1981 | Japan . |
| 58-199189 | 11/1983 | Japan . |
| 59-114096 | 6/1984 | Japan . |
| 59-167292 | 9/1984 | Japan . |
| 60-78782 | 5/1985 | Japan . |
| 62-164579 | 7/1987 | Japan . |
| 62-169681 | 7/1987 | Japan . |
| 59-93387 | 5/1989 | Japan . |
| 1178488 | 7/1989 | Japan . |

*Primary Examiner*—B. Hamilton Hess

*Attorney, Agent, or Firm*—Armstrong, Westerman, Hattori, McLeland & Naughton

[57] ABSTRACT

A thermosensitive recording material for recording thereon clear colored images having an excellent storage persistency over a long time, comprises a thermosensitive colored image-forming layer formed on a substrate and comprising a colorless dye precursor, a binder and a color developing agent comprising at least one compound having at least one group of the formula (I):

$$(R-SO_2-NH\underset{\underset{O}{\|}}{C}NH\rightarrow \qquad \text{(I)}$$

wherein R = unsubstituted aromatic group or substituted aromatic group having at least one substituent selected from alkyl, alkoxyl and halogen, and the thermosensitive colored image-forming layer further comprises an additive comprising at least one member selected from the compounds of the formulae (II) and (III):

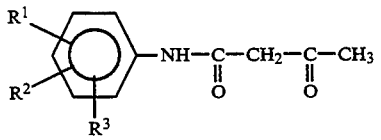

(II)

$$Ar_1-SO_2NH-Ar_2 \qquad \text{(III)}$$

wherein $R^1$, $R^2$, $R^3$ = alkyl, alkoxyl, aralkyl, aryl, aryloxy, nitro, acetylamino, acetoacetylamino, halogen or hydrogen; and $Ar_1$, $Ar_2$ = unsubstituted phenyl or naphthyl or substituted phenyl or naphthyl with 1 to 3 substituent selected from aryl, alkyl, alkoxyl, nitro, alkylamino, allyloxy, aryloxy and aralkyloxy groups and halogen atoms, one of $Ar_1$ and $Ar_2$ having a substituent selected from alkoxyl, allyloxy, phenoxy and benzyloxy groups.

7 Claims, No Drawings

THERMOSENSITIVE RECORDING MATERIAL

BACKGROUND OF THE INVENTION

1. Field of the Invention

The present invention relates to a thermosensitive recording material on which colored images are formed by heating. More particularly, the present invention relates to a thermosensitive recording material having a high thermosensitivity and being capable of forming thereon colored images resistant to fading and thus exhibiting a high degree of persistency during extended storage thereof.

The thermosensitive recording material of the present invention is capable of recording thereon colored images exhibiting an excellent resistance to moisture, heat, oily and fatty substances, and plasticizers, and thus has superior persistency when stored over a long period of time and therefore is useful as colored image-recording sheets, sheets for use in facsimiles, word processors, CRT image printers and cash dispensers, as passenger tickets, commuter passes, labels such as POS labels, cards such as prepaid cards, and as transit passes.

2. Description of the Related Arts

It is known that a conventional thermosensitive recording material comprises a supporting substrate, for example, a paper sheet, synthetic paper sheet, or plastic resin film and a thermosensitive colored image-forming layer formed on a surface of the supporting substrate and comprising a dye precursor, for example, an electron-donative leuco basic dye, a color-developing agent consisting of an electron-acceptive organic acid substance, for example, a phenolic compound, and a binder. When the thermosensitive colored image-forming layer is heated imagewise, colored images are recorded thereon by a reaction of the dye precursor with the color-developing agent.

This type of thermosensitive recording material is disclosed in Japanese Examined Patent Publication (Kokoku) Nos. 43-4,160 and 45-14,039 and Japanese Unexamined Patent Publication (Kokai) No. 48-27,736, and is widely employed in practice.

Namely, the thermosensitive recording material is advantageous in that colored images can be easily formed by heating alone, and the recording apparatus can be made compact and small in size, has a relatively low price, and can be easily maintained. Therefore, the thermosensitive recording material is appreciated as a useful information-recording material for recording outputs of printers used with, for example, computers, facsimile machines, automatic ticket-vending machines, scientific measurement recorders, and CRT medical measurement recorders.

Nevertheless, the conventional dye-forming type thermosensitive recording materials in which the thermosensitive colored image-forming layer comprises a conventional color-developing agent together with the dye precursor and the binder is disadvantageous in that the resultant colored images fade with the lapse of time, presumably because of a reversible reaction of the dye precursor with the color-developing agent. This fading of the colored images is accelerated by exposure to light, high temperatures, and high humidity and is specifically promoted by contact with an oily or fatty substance, for example, salad oil, or a plasticizer, to such an extent that the faded images cannot be recognized.

Many attempts have been made to retard or inhibit the fading of the colored images formed on a conventional thermosensitive colored image-forming layer containing a substantially colorless dye precursor comprising a lactone ring compound.

For example, Japanese Unexamined Patent Publication (Kokai) Nos. 60-78,782, 59-167,292, 59-114,096 and 59-93,387 disclose a thermosensitive colored image-forming layer containing a phenolic antioxidant.

Japanese Unexamined Patent Publication (Kokai) No. 56-146,794 discloses a protective layer formed from a hydrophobic polymeric compound emulsion on a thermosensitive colored image-forming layer.

Japanese Unexamined Patent Publication (Kokai) No. 58-199,189 discloses formation of both an intermediate layer and a top layer on a thermosensitive colored image-forming layer; the former being formed from a water-soluble polymeric compound solution or a hydrophobic polymeric compound emulsion and the latter being formed from a solvent-soluble hydrophobic polymer on the intermediate layer.

Japanese Unexamined Patent Publication (Kokai) No. 62-164,579 discloses a thermosensitive colored image-forming layer containing an epoxy compound in addition to a phenolic color-developing agent.

Japanese Unexamined Patent Publication (Kokai) No. 62-169,681 discloses metal salts of specific salicylic acid derivatives usable as a color-developing agent.

In the thermosensitive colored image-forming layer containing the phenolic antioxidant, the resultant colored images exhibit a higher resistance to heat and moisture to a certain extent compared to the colored images formed on a conventional colored image-forming layer free from the phenolic antioxidant, but the improvement effect of the phenolic antioxidant is not satisfactorily high. Also, the phenolic antioxidant does not have the capability to enhance the resistance of the colored images to the oily or fatty substances, for example, salad oil, and plasticizers, for example, dioctyl phthalate. The resistance of the colored images to oily or fatty substance or a plasticizer is determined in such a manner that the colored images are brought into contact with an oily or fatty substance, for example, a salad oil or a plasticizer, and left in contact therewith for a predetermined time, and then a retention of the color density of the tested colored images is measured in comparison with an initial color density thereof.

When the protective layer or the intermediate and top layers are formed on the thermosensitive colored image-forming layer, the resultant colored images exhibit a significantly enhanced persistency when the salad oil or the dioctyl phthalate is brought into contact with the colored image-forming surface of the recording material. Nevertheless, when the salad oil or the dioctyl phthalate is brought into contact with an edge face of the recording material, it penetrates the inside of the recording material and causes a complete fading of the colored images. Therefore, the provision of the protecting layer or the intermediate and top layer cannot completely eliminate the undesirable color-fading of the images.

The addition of the epoxy compound to the phenolic color developing agent, is not totally appreciated, because it takes a long time to stabilize the colored images formed on the colored image-forming layer after a heat-recording operation, and therefore, if salad oil or a plasticizer is brought into contact with the colored image-forming layer immediately after the heat-recording operation, the resultant colored images fade to a great extent.

The addition of the metal salts of the specific salicylic acid derivative to the colored image-forming layer effectively enhances the resistances of the colored image-forming layer to the oily or fatty substances and to the plasticizers. When the resultant thermosensitive recording sheet is subjected to a colored image-recording procedure and then to a heat resistance test, however, an undesirable color-development occurs on non-image-formed white portions of the recorded sheet. Also, the utilization of the specific salicylic acid derivative metal salts is disadvantageous in that this chemical has a complicated chemical structure and thus is expensive.

Generally, a thermosensitive recording material having a high persistency of colored images, which must have an additional surface layer, contains a special additive or use a special color-forming material, is disadvantageous in that the thermosensitivity is relatively low.

SUMMARY OF THE INVENTION

An object of the present invention is to provide a thermosensitive recording material having an excellent thermosensitivity and being capable of forming colored images thereon with high resistance to oily and fatty substances, plasticizers, moisture, and heat, and thus exhibiting superior persistency over a long time.

Another object of the present invention is to provide a thermosensitive recording material useful for thermorecording type tickets of automatic ticket-vending machines, commuter passes, and coupon tickets, which must have high persistency of the colored images recorded thereon, and for label sheets to be used in a POS bar code price-indicating system in which the label sheets are frequently attached to a surface of a polyvinyl chloride film containing a plasticizer and for wrapping fresh food or meat containing an oily or fatty substance; the label sheets of which are unavoidably brought into contact with the plasticizer and/or oily or fatty substance.

A further object of the present invention is to provide a thermosensitive recording material useful as facsimile recording sheets, word processor recording sheets, and CRT image printing sheets, which all must have high persistency of colored images recorded thereon.

The inventors of the present invention have made great efforts to provide a thermosensitive recording material having an excellent thermosensitivity and a high stability and persistency in the colored images formed thereon, and found that the aimed excellent thermosensitivity and high stability and persistency of the colored images can be attained by using a specific arylsulfonylureido-group containing compound as a color developing agent, in the presence of a thermally fusible additive comprising at least one member selected from specific acetoacetanilide compounds and sulfonamide compounds.

Namely, the above-mentioned objects can be attained by the thermosensitive recording material of the present invention, which comprises a substrate sheet; and a thermosensitive colored image-forming layer formed on a surface of the substrate sheet and comprising a substantially colorless dye precursor, a color developing agent reactive with the dye precursor upon heating to thereby develop a color, and a binder, the color developing agent comprising at least one compound comprising, per molecule thereof, at least one arylsulfonylureido group of the formula (I):

$$(R-SO_2-NH\underset{\underset{O}{\|}}{C}NH\rightarrow \qquad (I)$$

wherein R represents a member selected from the group consisting of unsaturated aromatic groups and substituted aromatic groups having at least one substituent selected from the group consisting of lower alkyl groups, lower alkoxyl groups and halogen atoms, and the thermosensitive colored image-forming layer further comprising a thermally fusible additive comprising at least one compound selected from the group consisting of:

(1) acetoacetanilide compounds of the formula (II):

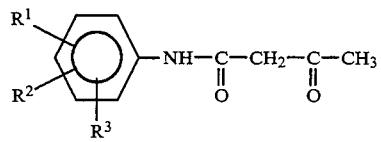

(II)

wherein $R^1$, $R^2$and $R^3$ respectively and independently from each other represent a member selected from the group consisting of alkyl groups, alkoxyl groups, aralkyl groups, aryl groups, aryloxy groups, nitro group, acetylamino group, acetoacetylamino group, hydrogen atom and halogen atoms; and (2) sulfonamide compounds of the formula (III):

$$Ar_1-SO_2NH-Ar_2 \qquad (III)$$

wherein $Ar_1$ and $Ar_2$ respectively and independently from each other represent a member selected from the group consisting of unsubstituted phenyl and naphthyl groups, and substituted phenyl and naphthyl groups each having 1 to 3 substituents selected from the group consisting of aryl groups, alkyl groups, alkoxyl groups, nitro group, halogen atoms, alkylamino groups, allyloxy group, aryloxy groups, and aralkyloxy groups, and one of $Ar_1$ and $Ar_2$ has at least one substituent selected from the group consisting of alkoxyl groups, allyloxy group, phenoxy group and benzyloxy group.

DESCRIPTION OF THE PREFERRED EMBODIMENTS

In the thermosensitive recording material of the present invention, a thermosensitive colored image-forming layer is formed on a surface of a substrate sheet and comprises a substantially colorless dye precursor, a specific color developing agent reactive with the dye precursor upon heating to thereby develop a color, a specific additive and a binder.

The color developing agent comprises at least one compound having, per molecule thereof, at least one arylsulfonylureido group of the formula (I):

$$(R-SO_2-NH\underset{\underset{O}{\|}}{C}NH\rightarrow \qquad (I)$$

wherein R represents a member selected from the group consisting of unsubstituted aromatic groups, for example, phenyl and naphthyl groups, and substituted aromatic groups having at least one substituent selected from the group consisting of lower alkyl groups preferably having 1 to 6 carbon atoms, lower alkoxyl groups preferably having 1 to 4 carbon atoms and halogen atoms, for example, fluorine, chlorine and bromine atoms.

In the thermosensitive recording material of the present invention, the thermosensitive colored image-forming layer comprises, in addition to the dye precursor, the color developing agent containing the above-mentioned arylsulfonylureido group-containing compound and the binder, a thermally fusible additive comprising at least one member selected from the group consisting of:

(1) acetoacetanilide compound of the formula (II):

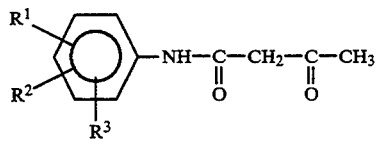

(II)

wherein $R^1$, $R^2$, $R^3$ respectively and independently from each other represent a member selected from the group consisting of alkyl groups preferably having 1 to 6 carbon atoms, alkoxyl groups preferably having 1 to 4 carbon atoms, aralkyl groups, for example, benzyl and phenyl groups, aryl groups, for example, phenyl, naphthyl and tolyl, aryloxy groups, for example, phenoxy, naphthoxy, tolyloxy and xylyloxy, nitro group, acetylamino group, acetoacetylamino group, hydrogen atom and halogen atoms, for example, fluorine, chlorine and bromine atoms, at least one of $R^1$, $R^2$ and $R^3$ being not a hydrogen atom, and (2) sulfonamide compounds of the formula (III):

$$Ar_1—SO_2NH—Ar_2 \quad (III)$$

wherein $Ar_1$ and $Ar_2$ respectively and independently from each other represent a member selected from the group consisting of unsubstituted phenyl and naphthyl groups and substituted phenyl and naphthyl groups each having 1 to 3 substituents selected from the group consisting of aryl groups, for example, phenyl, tolyl and naphthyl, alkyl groups preferably having 1 to 6 carbon atoms, alkoxyl groups preferably having 1 to 4 carbon atoms, nitro group, halogen atoms, for example, fluorine, chlorine and bromine atoms, alkylamino groups, for example, diethylamino and dimethylamino, allyloxy group, aryloxy groups, for example, phenoxy and naphthoxy, and aralkyloxy groups, for example, benzyloxy and phenethyloxy, and one of $Ar_1$ and $Ar_2$ has at least one substituent selected from the group consisting of alkoxyl groups, preferably having 1 to 4 carbon atoms, allyloxy group, phenoxy group and benzyloxy group.

The color-developing compounds having at least one arylsulfonylureido group of the formula (I) do not have acidic functional groups, for example, a phenolic hydroxyl group or carboxyl group. Nevertheless, the compounds having the arylsulfonylureido group of the formula (I) exhibit a strong color developing ability for the dye precursor consisting of a basic leuco dye. The reasons for the strong color developing ability have not yet been completely made clear, but it is assumed that the urea group in the color-developing compound is activated by the sulfonyl group located adjacent to the urea group and exhibits color developing activity.

Also, the reasons for the superior persistency of the colored images developed by the color-developing compound having the arylsulfonylureido group of the formula (I) even in various severe circumstances have not yet been completely made clear, but it is presumed that a synergistic effect of the one or more arylsulfonylureido groups of the formula (I) are highly contributory to stabilizing the resultant colored images.

In the color development by heating together with the precursory dye, the employment of the thermally fusible additive comprising at least one member selected from the acetoacetanilide compounds of the formula (II) and the arylsulfonamide compounds of the formula (III), together with the specific color developing compound having the arylsulfonylureido group of the formula (I), effectively causes the resultant colored images, even immediately after the formation thereof, to exhibit an excellent resistance to oily and fatty substances and plasticizers, moisture and heat and thus a superior persistency over a long period of time.

In a conventional thermosensitive recording material, it is known to use an acetanilide compound as a thermally fusible material together with a conventional phenolic color developing agent typically consisting of 2,2-bis(4-hydroxyphenyl)propane, namely bisphenol A, from Japanese Examined Patent Publication (Kokoku) No. 57-16914. This type of conventional color developing system containing the phenolic color developing compound and the acetanilide compound is disadvantageous in that when the resultant colored image-recorded material is stored at a relatively high temperature, an undesirable fogging occurs in non-colored portions of the thermosensitive colored image-forming layer.

Also, in another conventional thermosensitive recording material, a use of some arylsulfonamide compounds of the formula (III) as a thermally fusible (sensitizing) agent, in combination with a conventional phenolic color-developing compound, typically represented by bisphenol A, is known from Japanese Examined Patent Publication Nos. 2-37,876 and 3-26,675. However, this combination is disadvantageous in that the resultant thermosensitive colored image-forming layer exhibits an unsatisfactorily low whiteness and the colored image-recorded material is undesirably fogged in non-colored portions thereof during storage at a relatively high temperature.

The color-developing compound having at least one arylsulfonylureido (or arylsulfonylaminocarbonylamino) group of the formula (I) and usable for the present invention is preferably selected from the following groups of compounds.

(1) Compounds having one arylsulfonylureido group of the formula (I):

N-(p-toluenesulfonyl)-N'-phenylurea (melting point: 165° C.),

N-(p-toluenesulfonyl)-N'-(p-methoxyphenyl)urea (m.p.: 155° C.),

N-(p-toluenesulfonyl)-N'-(o-tolyl)urea (m.p.: 148° C.),

N-(p-toluenesulfonyl)-N'-(m-tolyl)urea (m.p.: 184° C.),

N-(p-toluenesulfonyl)-N'-(p-tolyl)urea (m.p.: 149° C.),

N-(p-toluenesulfonyl)-N'-(p-n-butylphenyl)urea,

N-(p-toluenesulfonyl)-N'-(o-chlorophenyl)urea (m.p.: 180° C.),

N-(p-toluenesulfonyl)-N'-(m-chlorophenyl)urea (m.p.: 193° C.),

N-(p-toluenesulfonyl)-N'-(2,4-dichlorophenyl)urea,
N-(p-toluenesulfonyl)-N'-benzylurea (m.p.: 177° C.),
N-(p-toluenesulfonyl)-N'-(1-naphthyl)urea (m.p.: 124° C.),
N-(p-toluenesulfonyl)-N'-(1-(2-methylnaphtyl))urea,
N-(benzenesulfonyl)-N'-phenylurea (m.p.: 153° C.),
N-(p-chlorobenzenesulfonyl)-N'-phenylurea,
N-(o-toluenesulfonyl)-N'-phenylurea,
N-(p-toluenesulfonyl)-N'-methylurea (m.p.: 172° C.),
N-(p-toluenesulfonyl)-N'-ethylurea (m.p.: 141° C.),
N-(p-toluenesulfonyl)-N'-(2-phenoxyethyl)urea (m.p.: 191° C.),
N,N'-bis(p-toluenesulfonyl)urea (m.p.: 155° C.),
N-(p-toluenesulfonyl)-N'-(o-diphenyl)urea (m.p.: 148° C.),
N-(p-toluenesulfonyl)-N'-(pethoxycarbonylphenyl-)urea,
N-(p-toluenesulfonyl)-N'-butylurea (m.p.: 126° C.),
N-(p-chlorobenzenesulfonyl)-N'-propylurea (m.p.: 127° C.), and
N-(p-methoxybenzenesulfonyl)-N'-phenylurea (m.p.: 149° C.).

(2) Compounds having two or more arylsulfonylureido groups of the formula (I):

bis((p-toluenesulfonyl)ureido)ketone
1,2-bis(N'-(p-toluenesulfonyl)ureido)ethane,
1,1,6,6-tetra(N'(p-toluenesulfonyl)ureido)heptane
1,5-bis(N'-(p-toluenesulfonyl)ureido)-3-oxapentane,
1,5-bis(N'-(p-toluenesulfonyl)ureido)-3-thiopentane,
1,3-bis(N'-(p-toluenesulfonyl)ureido)-2-propanone,
1,5-bis(N'-(p-toluenesulfonyl)ureido)-3-(2-(N'-(p-toluenesulfonyl)ureido)ethyl)-3-azapentane,
4,4'-bis(N'-(p-toluenesulfonyl)ureido)-diphenylmethane,
4,4'-bis(N'-(o-toluenesulfonyl)ureido)-diphenylmethane,
4,4'-bis(benzenesulfonylureido)-diphenylmethane,
4,4'-bis(1-naphthalenesulfonylureido)-diphenylmethane,
2,2-bis(4',4''-(N'-(p-toluenesulfonyl)ureido)-phenyl)-propane,
1,2-bis(4'-(N'-(p-toluenesulfonyl)ureido)-phenyloxy)ethane,
2,5-bis((N'-(p-toluenesulfonyl)ureido)methyl)-furan,
1,3-bis(N'-(p-toluenesulfonyl)ureido)benzene,
1 ,4-bis(N'-(p-toluenesulfonyl)ureido)benzene,
1 ,5-bis(N'-(p-toluenesulfonyl)ureido)-naphthalene
1,8-bis (N'-(p-toluenesulfonyl)ureido)-naphthalene,
4,4'-bis(N'-(p-toluenesulfonyl)ureido)-diphenylether,
3,3'-bis(N'-(p-toluenesulfonyl)ureido)-diphenylsulfone,
4,4'-bis(N'-(p-toluenesulfonyl)ureido)-diphenylsulfone,
2,4-bis(N'-(p-toluenesulfonyl)ureido)toluene,
2,6-bis(N'-(p-toluenesulfonyl)ureido)toluene,
4,4'-bis(N'-(p-toluenesulfonyl)ureido)-diphenylsulfide, and
3,4'-bis(N'-(p-toluenesulfonyl)ureido)-diphenylether.

The above-mentioned compounds can be employed alone or in a mixture of two or more thereof.

The thermally fusible acetoacetanilide compounds of the formula (II) and arylsulfonamide compounds of the formula (III) preferably have a melting temperature of from 60° C. to 180° C., more preferably 60° C. to 160° C.

If the melting temperature is lower than 60° C., sometimes an undesirable color-developing reaction occurs during production of the thermosensitive recording material, and/or the resultant thermosensitive colored image-forming layer exhibits an unsatisfactorily low whiteness.

If the melting temperature is higher than 180° C., sometimes it becomes difficult to provide a thermosensitive colored image-forming layer having a satisfactorily high thermosensitivity.

The acetoacetanilide compound of the formula (II) is preferably selected from the group consisting of:

p-chloroacetoacetanilide (melting point: 131° C.),
o-chloroacetoacetanilide (m.p.: 103° C.),
acetoacetanilide (m.p.: 83° C.),
o-methylacetoacetanilide (m.p.: 104° C.),
p-methylacetoacetanilide (m.p.: 92° C.),
o-methoxyacetoacetanilide (m.p.: 83° C.),
p-methoxyacetoacetanilide (m.p.: 113° C.),
p-ethoxyacetoacetanilide (m.p.: 103° C.),
p-acetylaminoacetoacetanilide (m.p .: 156° C.),
2,4-dimethylacetoacetanilide (m.p. : 88° C.),
5-chloro-2-methoxyacetoacetanilide (m.p.: 90° C.),
2,4-dimethoxyacetoacetanilide (m.p .: 92° C.),
2,5-dimethoxyacetoacetanilide (m.p .: 69° C.),
4-chloro-2,5-dimethoxyacetoacetani lide (m.p: 99° C.),
o-nitroacetoacetanilide,
m-nitroacetoacetanilide,
p-nitroacetoacetanilide,
2-methoxy-5-methylacetoacetanilide,
2-methoxy-4-nitroacetoacetanilide,
2,5-dichloroacetoacetanilide,
1,3-bis(acetoacetylamino)benzene,
1,4-bis(acetoacetylamino)benzene,
o-ethylacetoacetanilide,
2-chloro-4-methylacetoacetanilide,
4-methoxy-2-nitroacetoacetanilide,
2,4-dimethoxy-5-chloroacetoacetanilide,
2,5-diethoxy-4-chloroacetoacetanilide, and
o-ethoxyacetoacetanilide.

The arylsulfonamide compound of the formula (III) is preferably selected from the group consisting of:

4'-methoxy-p-toluenesulfonanilide (melting point: 112° C.
2'-methoxy-p-toluenesulfonanilide (m.p.: 129° C.),
4'-ethoxy-p-toluenesulfonanilide (m.p.: 99° C.),
2'-ethoxy-p-toluenesulfonanilide (m.p.: 153° C.),
4'-methoxy-benzenesulfonanilide (m.p.: 93° C.),
3'-methoxy-benzenesulfonanilide (m.p.: 83° C.),
2'-methoxy-benzenesulfonanilide (m.p.: 87° C.),
4'-ethoxy-benzenesulfonanilide (m.p.: 142° C.),
2'-ethoxy-benzenesulfonanilide,
4'-methoxy-p-chlorobenzenesulfonanilide,
2'-methoxy-p-chlorobenzenesulfonanilide,
4'-ethoxy-p-chlorobenzenesulfonanilide,
4'-methoxy-p-bromobenzenesulfonanilide (m.p.: 142° C.) ,
4'-methoxy-p-ethylbenzenesulfonanilide,
2'-methoxy-p-ethylbenzenesulfonanilide,
4'-methoxy-2,5-dimethylbenzenesulfonanilide,
4'-methoxy-naphthalene-2-sulfonanilide,
4'-methoxy-naphthalene-1-sulfonanilide,
2'-methoxy-naphthalene-2-sulfonanilide (m.p.: 158° C.),
2'-allyloxy-p-toluenesulfonanilide (m.p.: 103° C.),
2'-n-propoxy-p-toluenesulfonanilide (m.p.: 114° C.),
2'-n-butoxy-p-toluenesulfonanilide (m.p.: 85° C.),
4'-methoxy-o-toluenesulfonanilide,
2'-methoxy-o-toluenesulfonanilide,
4'-ethoxy-o-toluenesulfonanilide,
2'-ethoxy-o-toluenesulfonanilide, 2'-methoxy-5'-chloro-p-toluenesulfonanilide,
2',5'-dimethoxy-4'-chloro-benzenesulfonanilide,
2',5'-dimethoxy-benzenesulfonanilide,
2',4'-dimethoxy-benzenesulfonanilide,
3',5'-dimethoxy-benzenesulfonanilide,
4'-nitro-2'-methoxy-benzenesulfonanilide,
5'-nitro-2'-methoxy-benzenesulfonanilide,
2'-nitro-4'-methoxy-benzenesulfonanilide,
3', 4',5'-trimethoxy-benzenesulfonanilide,
4'-chloro-2'-methoxy-5'-methyl-benzenesulfonanilide,
2'-methoxy-5'-methyl-benzenesulfonanilide (m.p.: 110° C.),
4'-nitro-2'-methoxy-5'-methyl-benzenesulfonailide (m.p.: 150° C.),
4'-nitro-2'-ethoxy-5'-methyl-benzenesulfonanilide (m.p.: 175° C.),
4-methoxybenzenesulfonanilide (m.p.: 110° C.),
4'-methoxy-p-toluenesulfonanilide,
2-methoxybenzenesulfonanilide (m.p.: 161° C.),
4-ethoxybenzenesulfonanilide (m.p.: 84° C.),
2-ethoxybenzenesulfonanilide (m.p.: 158° C.),
3,4-dimethoxybenzenesulfonanilide (m.p.: 130° C.),
6'-methoxy-2'-nitro-m-toluenesulfonanilide (m.p.: 116° C.)
p-toluenesulfonyl-N-(4-methoxy-2-naphthyl)amide,
4,4'-dimethoxy-benzenesulfonanilide,
4-methoxy-4'-methyl-benzenesulfonanilide,
2'-benzyloxy-p-toluenesulfonanilide (m.p.: 100° C.),
3'-benzyloxy-p-toluenesulfonanilide (m.p.: 112° C.),
2'-phenoxy-p-toluenesulfonanilide,
4'-phenoxy-p-toluenesulfonanilide,
4'-phenyl-4-methoxybenzenesulfonanilide, and
4'-dimethylamino-4-methoxybenzenesulfonanilide.

The specific thermally fusible additive contained in the thermosensitive colored image-forming layer effectively enhances the thermal sensitivity of the colored image-forming layer and the resistance of the resultant colored images to oily and fatty substances, plasticizers, heat and moisture, even immediately after the formation of the colored images.

Preferably, the color developing compound having at least one arylsulfonylureido group of the formula (I) in the thermosensitive colored image-forming layer is present in an amount of 5 to 50%, preferably, 10 to 40%, based on the total dry weight of the thermosensitive colored image-forming layer.

When the content of the color developing compound is less than 5% by weight, the resultant thermosensitive colored image-forming layer sometimes exhibits an unsatisfactory color-forming performance, and when the content of the color developing compound of the formula (I) is more than 50% by weight, the resultant color-developing performance is saturated, and thus the resultant recording material is sometimes economically disadvantageous.

In the thermosensitive colored image-forming layer of the present invention, the specific thermally fusible additive as defined above is contained preferably in an amount of 5 to 50%, more preferably from 10 to 40%, based on the total dry weight of the thermosensitive colored image-forming layer. If the content of the specific additive is less than 5% by weight, the sensitizing effect thereof is sometimes unsatisfactory. Also, if the content of the specific additive is more than 50% by weight, the sensitizing effect thereof is sometimes saturated and thus the resultant recording material is economically disadvantageous.

The dye precursor usable for the present invention comprises at least one member selected from conventional triphenylmethane, fluoran, and diphenylmethane leuco dyes, for example, 3-(4-diethylamino-2-ethoxyphenyl)-3-(1-ethyl-2-methylindole-3-yl)-4-azaphthalide, crystal violet lactone, 3-(N-ethyl-N-isopentylamino)-6-methyl-7-anilinofluoran, 3-diethylamino-6-methyl-7-anilinofluoran, 3-diethylamino-6-methyl-7-(o- or p-dimethylanilino)fluoran, 3-(N-ethyl-N-p-toluidino)-6-methyl-7-anilinofluoran, 3-pyrrolidino-6-methyl-7anilinofluoran, 3-dibutylamino-6-methyl-7-anilinofluoran, 3-(N-cyclohexyl-N-methylamino)-6-methyl-7-anilinofluoran, 3-diethylamino-7-(o-chloroanilino)fluoran, 3-dibutylamino-7-(m-trifluoromethylanilino)fluoran, 3-diethylamino-7-chlorofluoran, 3-diethylamino-6methylfluoran, 3-cyclohexylamino-6-chlorofluoran, 3-(N-ethyl-N-hexylamino)-6-methyl-7-(p-chloroanilino)fluoran 3-diethylamino-7-(m-trifluoromethylanilino)fluoran, and 3-dipentylamino-6-methyl-7-anilinofluoran.

In the thermosensitive colored image-forming layer of the present invention, the dye precursor is present in an amount of 5 to 20% based on the total dry weight of the colored image-forming layer.

In the present invention, the thermosensitive colored image-forming layer optionally contains at least one further additive comprising at least one member selected from the group consisting of aromatic compounds having at least one epoxy group and aromatic compounds having at least one aziridinyl group. Some of those aromatic compounds are disclosed in Japanese Unexamined Patent Publication Nos. 62-164,579, 2-220,885, and 2-255,376.

The aromatic epoxy compound is preferably selected from the group consisting of 4,4'-bis(2'',3''-epoxypropyloxy)diphenylsulfone, 2,2-bis(4'-(2'',3''-epoxypropyloxy)phenyl)propane, 1,4-bis(2',3'-epoxypropyloxy)benzene, 4-(2''-methyl-2'',3''-epoxypropyloxy)-4'-benzyloxydiphenylsulfone, 4-(2'',3''-epoxypropyloxy)-4'-(p-methylbenzyloxy)diphenylsulfone, epoxidized orthonovolak cresol resins, 4,4'-bis(-2'',3''-epoxypropyloxy)diphenylmethane, 4,4'-bis(2'',3''-epoxypropylamino)diphenylmethane, bis(2'',3''-epoxypropyl)4,4'-methylene dibenzoate, 4,4'-bis(2'',3''-epoxypropyloxy)biphenyl, 4,4'-bis(2'',3''-epoxypropyloxy)3,3',5,5'-tetramethylbiphenyl, 2,6-bis(2',3'-epoxypropyloxy)naphthalene, and bis(2,3-epoxypropyl)-terephthalate.

The aromatic aziridinyl compound is preferably selected from the group consisting of 2,4-bis(1-aziridinylcarbonylamino)toluene, bis(4-(1-aziridinylcarbonylamino)phenyl)methane, bis(3-chloro-4(1-aziridinylcarbonylamino)phenyl)methane, 2,2-bis(4-(1-aziridinylcarbonyloxy)phenyl)propane, 1,4-bis(1-aziridinylcarbonyloxy)benzene, and 1,4-bis(1-aziridinylcarbonyl)benzene.

The aromatic epoxy and aziridinyl compounds are employed alone or as a mixture of two or more thereof. The aromatic epoxy and aziridinyl compounds effectively enhance the resistance of the resultant colored images to water, even immediately after the formation of the colored images.

Preferably, the aromatic epoxy and/or aziridinyl compound in the thermosensitive colored image-forming layer is present in an amount of 1 to 30%, preferably 2 to 10%, based on the total dry weight of the thermosensitive colored image-forming layer.

When the aromatic epoxy and/or aziridinyl compound employed in an amount of less than 1% by weight, the resultant colored image-stabilizing effect is sometimes unsatisfactory. Also, even if the aromatic aziridinyl compounds (2) are used in an amount of more than 30% by weight, no further enhancement of the stabilizing effect on the colored images is obtained.

In the thermosensitive colored image-forming layer of the present invention, the color developing agent optionally contains at least one conventional color-developing compound in addition to the specific compound having at least one arylsulfonylureido group of the formula (I), unless the color-forming performance of the resultant colored image-forming layer is disturbed thereby.

The conventional color developing compound is preferably selected from the group consisting of phenolic compounds and organic acid compounds, for example, 2,2-bis(4-hydroxyphenyl)propane (namely bisphenol A), 1,1-bis(4-hydroxyphenyl)-1-phenylethane, 1,4-bis(1-methyl-1-(4'-hydroxyphenyl)ethyl)benzene, 1,3-bis(1-methyl-l-(4'-hydroxyphenyl)ethyl)benzene, dihydroxydiphenylether (disclosed in JP-A-l-180,382), benzyl p-hydroxybenzoate (disclosed in JP-A-52-140,483), bisphenol S, 4-hydroxy-4'-isopropyloxy-diphenylsulfone (disclosed in JP-A-60-13,852), 1,1-di-(4-hydroxyphenyl)-cyclohexane, 1,7-di(4-hydroxyphenylthio)-3,5-dioxaheptane (disclosed in JP-A-59-52,694), and 3,3'-diallyl-4,4'-dihydroxydiphenylsulfone (disclosed in JP-A-60-208,286).

The above-mentioned conventional color developing compounds can be employed alone or as a mixture of two or more thereof.

When the conventional color developing compound is employed, its content in the colored image-forming layer is preferably 5 to 40% by weight.

The thermosensitive colored image-forming layer of the present invention optionally further comprises an additional heat-fusible organic substance different from the acetoacetanilide compounds of the formula (II) and the arylsulfonamide compounds of the formula (III), usually referred to as a sensitizer, inorganic and organic pigments, antioxidants, for example, hindered phenol compounds, ultraviolet ray-absorbers, and waxes.

The additional sensitizing agent comprises at least one organic compound having a melting point of from 50° C. to 150° C., for example, phenyl 1-hydroxy-2-naphthoate (disclosed in JP-A-57-191,089), p-benzylbiphenyl (JP-A-60-82,382), benzylnaphthylether (JP-A-58-87,094), dibenzyl terephthalete (JP-A-58-98,285), benzyl pbenzyloxybenxoate (JP-A-57-201,691), diphenyl carbonate, ditolyl carbonate (JP-A-58-136,489), m-terphenyl (JP-A-57-89,994), 1,2-bis(m-tolyloxy)ethane (JP-A-60-56,588), 1,5-bis(p-methoxyphenoxy)-3-oxapentane (JP-A-62-181,183), oxalic acid diesters (JP-A-64-1,583) and 1,4-bis(p-tolyloxy)benzene (JP-A-2-153,783).

The antioxidant, for example, hindered phenol compounds, and ultraviolet ray-absorber are preferably selected from those disclosed in JP-A-57-151,394, JP-A-58-160,191, JP-A-58-69,096, JP-A-59-2,884, JP-A-59-95,190, JP-A-60-22,288, JP-A-60-255,485, JP-A-61-44,686, JP-A-62-169,683, JP-A-63-17,081, JP-A-1-249,385, and JP-A-4-144,786 for example, 1,1,3tris(2'-methyl-3'-cyclohexyl-4'-hydroxyphenyl)butane; 1,1,3-tris(2-methyl-4-hydroxy-5-cyclohexylphenyl)butane, 1,1,3-tris(2-methyl-4-hydroxy-5-tert-butylphenyl)butane, 4,4'-thio-bis(3-methyl-6-tert-butylphenol), 1,3,5-trimethyl-2,4,6-tris(3,5-di-tert-butyl-4hydroxybenzyl)-benzene, 2,2'-dihydroxy-4, 4'-dimethoxybenzophenone, p-octylphenylsalycilate, 2-(2'-hydroxy-5'-methylphenyl)benzotriazole, ethyl-2-cyano-3,3'-diphenyl acrylate, and tetra(2,2,6,6-tetramethyl-4-piperidyl)-1,2,3,4-butane-tetracarbonate.

The antioxidant and/or the ultraviolet ray-absorber is preferably contained in an amount of 1 to 10% by weight in the thermosensitive colored image-forming layer.

The inorganic and organic pigments usable for the present invention are preferably selected from inorganic fine particles of, for example, calcium carbonate, silica, zinc oxide, titanium dioxide, aluminum hydroxide, zinc hydroxide, barium sulfate, clay, anhydrous clay, talc and surface-modified calcium carbide and silica and organic fine particles of, for example, urea-formaldehyde resins, styrene-methacrylate copolymer resins and polystyrene resins.

The waxes usable for the present invention preferably comprise at least one member selected from, for example, paraffin waxes, carnauba wax, microcrystalline waxes, polyethylene waxes, amide type waxes, bisimide type waxes, higher fatty acid amide waxes, for example, stearic acid amide, ethylene-bisstearoamide wax, higher fatty acid esters and metal salts, for example, zinc stearate, aluminum stearate, calcium stearate, and zinc oleate.

In the colored image forming layer of the present invention, the wax and organic or inorganic pigment are optionally contained in amounts of 2 to 50% by weight, respectively.

The binder usable for the present invention preferably comprises at least one member selected from water-soluble polymeric materials, for example, polyvinyl alcohols of various molecular weights, starch and starch derivatives, cellulose derivatives, for example, methoxy cellulose, carboxymethyl cellulose, methyl cellulose and ethyl cellulose, sodium polyacrylate, polyvinyl pyrrolidine, acrylic acid amide-acrylic acid ester copolymers, acrylic acid amide-acrylic acid estermethacrylic acid terpolymers, alkali salts of styrenemaleic anhydride copolymers, polyacrylic acid amide, sodium alginate, gelatine and casein, and water-insoluble polymeric materials, for example, polyvinyl acetate resins, polyurethane resins, styrene-butadiene copolymer resins, polyacrylic acid resins, polyacrylic acid ester resins, vinyl chloride-vinyl acetate copolymer resins, polybutyl acrylate, ethylene-vinyl acetate copolymer resins and styrene-butadiene-acrylic compound-terpolymer resins, used in the form of a latex.

The binder is present in an amount of 5 to 20% by weight, based on the total dry weight of the colored image-forming layer.

The substrate sheet usable for the present invention is not limited to a specific group of materials, and usually the sheet substrate comprises a member selected from fine paper sheets, coated paper sheets having a clay or resin latex-coated layer, cast-coated paper sheets, paper boards, plastic resin films, synthetic paper sheets comprising a plastic resin such as a polyolefin resin and a multi-layer structure, and laminated composite sheets. Preferably, the sheet substrate has a basis weight of 40 to 170 g/m$^2$.

The colored image-forming layer can be formed on a surface of sheet substrate, by applying a coating liquid containing the above-mentioned components, and by drying and solidifying the coating liquid layer on the sheet substrate.

The colored image-forming layer is preferably present in a dry weight of from 1 to 15 g/m$^2$, more preferably 2 to 10 g/m$^2$.

In the present thermosensitive recording material, a protective layer and/or a layer for printing may be formed on the colored image-forming layer.

In the thermosensitive recording material of the present invention, the color developing compounds having at least one arylsulfonylureido group of the formula (I) per molecule thereof exhibit a color-developing activity comparative to or higher than that of bisphenol A which is a typical conventional color developing compound.

Also, the combination of the specific color developing compound with the specific additive comprising at least one member selected from the acetoacetanilide compounds of the formula (II) and the arylsulfonamide compounds of the formula (III) as defined above effectively causes the resultant colored image-forming layer to exhibit a significantly enhanced thermosensitivity and the resultant colored images to exhibit an excellent resistance to oily and fatty substances and a plasticizer even immediately after the color development, and thus have a superior storage persistency.

EXAMPLES

The present invention will be further explained by the following specific examples, which are merely representative and do not in any way restrict the scope of the present invention.

EXAMPLE 1

A thermosensitive recording paper sheet was prepared by the following procedures.

(1) Preparation of a piqment-coated paper sheet

A coating liquid was prepared by mixing an aqueous anhydrous clay dispersion prepared by dispersing 85 parts by weight of anhydrous clay (trademark: Ansilex, made by Engelhard Corp.) in 320 parts by weight of water, with 40 parts by weight of an aqueous emulsion of a styrene-butadiene copolymer in a solid content of 50% by weight, and 50 parts by weight of a 10% aqueous oxidized starch solution.

The coating liquid was coated on a surface of a fine paper sheet having a basis weight of 48 g/m$^2$, to form a coating layer having a dry weight of 7.0 g/m$^2$, whereby a pigment-coated paper sheet was obtained.

(2) Preparation of an aqueous dye precursor dispersion A

A mixture was prepared in the following composition.

| Component | Part by weight |
|---|---|
| 3-(N-isopentyl-N-ethylamino)-6-methyl-7-anilinofluoran | 20 |
| 10% aqueous solution of polyvinyl alcohol | 10 |
| Water | 70 |

The mixture was dispersed in a sand grinder to an extent such that the resultant dispersed solid particles had an average size of 1 μm or less.

(3) Preparation of an aqueous color-developing agent dispersion B

A mixture was prepared in the following composition.

| Component | Part by weight |
|---|---|
| N-(p-toluenesulfonyl)-N'-phenylurea | 20 |
| 10% aqueous solution of polyvinyl alcohol | 10 |
| Water | 70 |

The mixture was dispersed in a sand grinder to such an extent that the resultant dispersed solid particles had an average size of 1 μm or less.

(4) Preparation of an aqueous acetoacetanilide compound dispersion C

| Component | Part by weight |
|---|---|
| o-chloroacetoacetanilide | 20 |
| 10% aqueous solution of polyvinyl alcohol | 10 |
| Water | 70 |

The mixture was dispersed in a sand grinder to such an extent that the resultant dispersed solid particles had an average size of 1 μm or less.

(5) Formation of thermosensitive colored image-forming layer

A coating liquid was prepared by mixing parts by weight of the aqueous dye precursor dispersion A and 120 parts by weight of the aqueous color-developing agent dispersion B and 120 parts by weight of the aqueous acetoacetanilide compound dispersion C with 26 parts by weight of a calcium carbonate pigment, 12 parts by weight of a 25% aqueous zinc stearate dispersion, 10 parts by weight of a 30% aqueous paraffin dispersion and 80 parts by weight of a aqueous polyvinyl alcohol solution, by agitating the mixture.

A surface of the pigment-coated paper sheet was coated with the resultant coating liquid and dried. A thermosensitive colored image-forming layer was formed with a weight of 5.0 g/m$^2$.

(6) Calenderinq treatment

The recording sheet was treated by a super calender, and the calendered surface of the recording sheet had a Bekk smoothness of 600 to 1,000 seconds.

A thermosensitive recording sheet was obtained.

(7) Performance test

Specimens of the resultant thermosensitive recording sheet were subjected to a colored image-developing test by using a dynamic color-developing tester provided by modifying a thermosensitive facsimile printer with an applied energy of 0.39 mj/dot or 0.49 mj/dot.

The resultant colored images were subjected to a measurement of a color density by a Macbeth Reflection Color Density Tester RD-914 (trademark). The measured colored density of the colored images on the specimen is referred to as an initial color density ($D_0$) of the colored images.

Also, specimens were heated by a Heat Inclination Tester made by Toyo Seiki K.K., at a temperature of 70° C. under a pressure of 2.5 kg/cm$^2$ for 5 seconds, and the color density of the heat-developed color on the specimens was measured by the abovementioned color density tester. The color-forming property of the specimens is referred to as a static color-forming performance of the specimens which represents a resistance of the specimens to color-formation at a relatively high temperature.

The test results are shown in Table 1.

EXAMPLE 2

A thermosensitive recording sheet was prepared and tested using the same procedure as in Example 1 except that during the preparation of the aqueous acetoacetanilide compound dispersion C, o-chloroacetoacetanilide was replaced by p-chloroacetoacetanilide.

The test results are shown in Table 1.

EXAMPLE 3

A thermosensitive recording sheet was prepared and tested using the same procedure as in Example 1 except that during the preparation of the aqueous dye precursor dispersion A, 3-(N-ethyl-N-isopentylamino)-6-methyl-7-anilinofluoran was replaced by 3-dibutylamino-6-methyl-7-anilinofluoran and during the preparation of the aqueous color developing agent dispersion B, N-(p-toluenesulfonyl)-N'-phenylurea was replaced by N-(p-toluenesulfonyl)-N'-(p-methoxyphenyl)urea. The test results are shown in Table 1.

COMPARATIVE EXAMPLE 1

A thermosensitive recording sheet was prepared and tested using the same procedure as in Example 1 except that in the formation of the thermosensitive colored image-forming layer, the use of the aqueous acetoacetanilide compound dispersion C was omitted.

The test results are shown in Table 1.

COMPARATIVE EXAMPLE 2

A thermosensitive recording sheet was prepared and tested using the same procedure as in Example 1 except that during the preparation of the aqueous color developing agent dispersion B, N-(p-toluenesulfonyl)-N'-phenylurea was replaced by 2,2-bis(4-hydroxyphenyl)-propane, namely bisphenol A.

The test results are shown in Table 1.

TABLE 1

| Example No. | | Item: Color density 0.39 mj/dot | Color density 0.49 mj/dot | Static color-forming performance |
|---|---|---|---|---|
| Example | 1 | 1.32 | 1.40 | 0.09 |
| | 2 | 1.29 | 1.38 | 0.08 |
| | 3 | 1.31 | 1.39 | 0.06 |
| Comparative | 1 | 0.75 | 1.02 | 0.05 |
| Example | 2 | 1.30 | 1.37 | 0.73 |

Table 1 clearly indicates that when the specific color-developing compound having at least one arylsulfonylureido group of the formula (I) was used as a color developing agent in combination of the thermally fusible acetoacetanilide compound of the formula (II), the resultant thermosensitive colored image-forming layer exhibited a high thermosensitivity comparative to or higher than that produced by using a conventional typical color developing agent consisting of bisphenol A, and a high resistance to undesirable color formation (fogging) at a temperature of 70° C.

EXAMPLE 4

A thermosensitive recording sheet was prepared and tested using the same procedure as in Example 1 except that during the preparation of the aqueous color developing agent dispersion B, N-(p-toluenesulfonyl)-N'-phenylurea was replaced by, 4,4'-bis(ptoluenesulfonylureido)diphenylmethane.

Specimens of the resultant thermosensitive recording sheet were subjected to a colored image-developing test by using a dynamic color-developing tester provided by modifying a thermosensitive facsimile printer with an applied energy of 0.39 mj/dot or 0.49 mj/dot.

The resultant colored images were subjected to a measurement of color density by a Macbeth Reflection Color Density Tester RD-914 (trademark). The measured colored density of the colored images on the specimen is referred to as an initial color density ($D_0$) of the colored images.

Then, the specimens color-developed with an applied energy of 0.49 mj/dot were subjected to a resistance test to an oil and a plasticizer in the following manner.

Within 30 minutes from the completion of the color-developing operation, colored image-formed surfaces of the specimens were coated with salad oil or dioctyl phthalate (DOP), which is a typical plasticizer, and left to stand at room temperature for 30 minutes. Then, the oil or plasticizer was wiped away from the specimen surfaces, and the color density of the colored images retained on the specimens was measured by a Macbeth Reflection Color Density Tester. The measured color density is referred to as a color density (D) of the oil or plasticizer-treated colored images.

The retention in color density of the colored images was calculated in accordance with the following equation:

$$CIR\ (\%) = \frac{D}{D_0} \times 100$$

wherein CIR represents the retention in % in color density of the colored images, $D_0$ represents the initial color density of the colored images, and D represents the color density of the oil or plasticizer-treated colored images.

The test results are shown in Table 2.

EXAMPLE 5

A thermosensitive recording sheet was prepared and tested using the same procedure as in Example 4 except that during the preparation of the aqueous acetoacetanilide compound dispersion C, o-chloroacetoacetanilide was replaced by p-chloroacetoacetanilide.

The test results are shown in Table 2.

EXAMPLE 6

A thermosensitive recording sheet was prepared and tested using the same procedure as in Example 4 except that during the preparation of the aqueous acetoacetanilide compound dispersion C, o-chloroacetoacetanilide was replaced by o-methylacetoacetanilide.

The test results are shown in Table 2.

EXAMPLE 7

A thermosensitive recording sheet was prepared and tested using the same procedure as in Example 4 except that during the preparation of the aqueous acetoacetanilide compound dispersion C, o-chloroacetoacetanilide was replaced by 2,4-dimethylacetoacetanilide.

The test results are shown in Table 2.

EXAMPLE 8

A thermosensitive recording sheet was prepared and tested using the same procedure as in Example 4 except that during the preparation of the aqueous acetoacetanilide compound dispersion C, o-chloroacetoacetanilide was replaced by p-methylacetoacetanilide.

The test results are shown in Table 2.

EXAMPLE 9

A thermosensitive recording sheet was prepared and tested using the same procedure as in Example 4 except that during the preparation of the aqueous dye precursor dispersion A, 3-(N-isopentyl-N-ethylamino)-6-methyl-7-anilinofluoran was replaced by 3-dibutyl-amino-6-methyl-7-anilinofluoran, and during the preparation of the aqueous color developing agent dispersion B, 4,4'-bis(p-toluenesulfonylureido)diphenylmethane was replaced by 4,4'-bis(p-toluenesulfonylureido)diphenylether.

The test results are shown in Table 2.

EXAMPLE 10

A thermosensitive recording sheet was prepared and tested using the same procedure as in Example 4 except that in the formation of the thermosensitive colored image-forming layer, the composition of the aqueous color developing agent dispersion B was changed to the following composition.

Preparation of Aqueous Color-Developing Agent Dispersion

| Component | Part by weight |
|---|---|
| 4,4'-bis(p-toluenesulfonyl-ureido)diphenylmethane | 12 |
| N-(p-toluenesulfonyl)-N'-phenylurea | 8 |
| 10% aqueous polyvinyl alcohol solution | 10 |
| Water | 70 |

The mixture was dispersed by using a sand grinder to such an extent that the resultant dispersed solid particles had an average size of 1 μm or less.

The test results are shown in Table 2.

EXAMPLE 11

A thermosensitive recording sheet was prepared and tested using the same procedure as in Example 4 except that in the formation of the thermosensitive colored image-forming layer, the composition of the aqueous color developing agent dispersion B was changed to the following composition.

Preparation of Aqueous Color-Developing Aqent Dispersion

| Component | Part by weight |
|---|---|
| 4,4'-bis(p-toluenesulfonyl-aminocarbonylamino)diphenylmethane | 12 |
| N-(p-toluenesulfonyl)-N'-butylurea | 8 |
| 10% aqueous polyvinyl alcohol solution | 10 |
| Water | 70 |

The mixture was dispersed by using a sand grinder to such an extent that the resultant dispersed solid particles had an average size of 1 μm or less.

The test results are shown in Table 2.

COMPARATIVE EXAMPLE 3

A thermosensitive recording sheet was prepared and tested using the same procedure as in Example 4 except that during the preparation of the aqueous color developing agent dispersion B, 4,4'-bis(p-toluenesulfonylureido)diphenylmethane was replaced by 2,2-bis(4-hydroxyphenyl)propane (namely bisphenol A).

The test results are shown in Table 2.

TABLE 2

| | Item | | | |
|---|---|---|---|---|
| | Color density | | Color density retention (%) | |
| Example No. | 0.39 mj/dot | 0.49 mj/dot | Salad oil | DOP |
| Example 4 | 1.31 | 1.38 | 100 | 90 |
| 5 | 1.30 | 1.36 | 100 | 89 |
| 6 | 1.27 | 1.36 | 99 | 88 |
| 7 | 1.26 | 1.35 | 100 | 90 |
| 8 | 1.29 | 1.38 | 100 | 88 |
| 9 | 1.28 | 1.37 | 98 | 87 |
| 10 | 1.36 | 1.42 | 93 | 55 |
| 11 | 1.35 | 1.40 | 93 | 56 |
| Comparative Example 3 | 1.30 | 1.37 | 21 | 18 |

EXAMPLE 12

A thermosensitive recording sheet was prepared and tested using the same procedure as in Example 7 with the following exceptions.

(1) Formation of a thermosensitive colored image-forming layer

A coating liquid was prepared by evenly mixing 60 parts by weight of the aqueous dye precursor dispersion A of Example 1, 120 parts by weight of the aqueous color developing agent dispersion B of Example 4, and 120 parts by weight of the aqueous acetoacetanilide compound dispersion C in which 2,4-dimethylacetoacetanilide was used in place of o-chloroacetoacetanilide, with 26 parts by weight of a calcium carbonate pigment, 12 parts by weight of a 25% aqueous zinc stearate dispersion, 14 parts by weight of a styrene-butadiene copolymer latex having a solid content of 50% by weight and 40 parts by weight of a 10% aqueous polyvinyl alcohol solution, while stirring.

A surface of a paper sheet having a basis weight of 50 $g/m^2$ was coated with the resultant coating liquid and dried to form a thermosensitive colored image-forming layer with a dry weight of 7.5 $g/m^2$.

(2) Formation of overcoat layer

A coating liquid for an overcoat layer was prepared by mixing 5 parts by weight of an aqueous dispersion of kaolinite clay having a solid content of 60% by weight, 35 parts by weight of a 10% aqueous polyvinyl alcohol solution, 22 parts by weight of 10% aqueous casein solution, 1 part by weight of a 25% aqueous zinc stearate dispersion, 2 parts by weight of dimethylolurea cross-linking agent and 35 parts by weight of water while stirring. The coating liquid was coated on the thermosensitive colored image-forming layer and dried, to form an overcoat layer having a dry weight of 1.5 $g/m^2$.

(3) Calendering treatment

The recording sheet was treated by a super calender, and the calendered surface of the recording sheet had a Bekk smoothness of 600 to 1,000 seconds.

A thermosensitive recording sheet was obtained.

(4) Test

Specimens of the resultant thermosensitive recording sheet were printed with letters and bar codes using a label printer (trademark: DP-110GS, made by Teraoka Seiko K.K.), to print a regular square pattern of 7 mm×7 mm. The color density of the color-formed portions of the specimens was measured by using a Macbeth Reflection Color Density Tester RD-914. By using the recorded bar code patterns, the bar code portion of each specimen was read by a bar code laser checker made by Symbol Technologies Co. The resultant readability (%) was recorded.

Then, the specimens were immersed in dioctyl phthalate (DOP) controlled at a temperature of 20° C. for 24 hours. The specimens were removed from the DOP and the surfaces of the specimens were wiped. The bar code portions of the specimens were subjected to a reading test using the bar code checker and the resultant readability (%) percentage was recorded.

The higher the readability (%) of the bar codes, the higher the clarity of the bar codes.

The test results are shown in Table 3.

COMPARATIVE EXAMPLE 4

A thermosensitive recording sheet was prepared and tested using the same procedure as in Example 12 except that during the preparation of the aqueous color developing agent dispersion B, 4,4'-bis(p-toluenesulfonylureido)diphenylmethane was replaced by 2,2-bis(4-hydroxyphenyl)propane (namely bisphenol A).

The test results are shown in Table 3.

TABLE 3

| | Item | | |
|---|---|---|---|
| | | Bar code readability (%) | |
| Example No. | Color density | Before immersion in DOP | After immersion in DOP |
| Example 12 | 1.37 | 100 | 99 |
| Comparative Example 4 | 1.35 | 100 | 0 |

Tables 2 and 3 clearly show that a combination of the conventional typical color developing agent consisting of bisphenol A with the acetoacetanilide compounds of the formula (II) caused the resultant colored images to exhibit a poor resistance to an oil and plasticizer. Compared with this, the specific combination of the color developing compounds having at least one arylsulfonylureido group of the formula (I) per molecule thereof with the acetoacetanilide compounds of the formula (II) effectively caused the resultant thermosensitive colored image-forming layer to exhibit an enhanced thermosensitivity comparative to or higher than that obtained by the above-mentioned combination, and the resultant colored images to exhibit a significantly enhanced resistance to an oil and plasticizer even immediately after the formation of the colored images.

EXAMPLE 13

A thermosensitive recording paper sheet was prepared by the following procedures.

(1) Preparation of a pigment-coated paper sheet

A coating liquid was prepared by mixing an aqueous anhydrous clay dispersion prepared by dispersing 85 parts by weight of anhydrous clay (trademark: Ansilex, made by Engelhard Corp.) in 320 parts by weight of water, with 40 parts by weight of an aqueous emulsion of a styrene-butadiene copolymer in a solid content of by weight, and 50 parts by weight of a 10% aqueous oxidized starch solution.

The coating liquid was coated on a surface of a fine paper sheet having a basis weight of 48 g/m$^2$, to form a coating layer having a dry weight of 7.0 g/m$^2$, whereby a pigment-coated paper sheet was obtained.

(2) Preparation of an aqueous dye precursor dispersion A

A mixture was prepared in the following composition.

| Component | Part by weight |
|---|---|
| 3-(N-isopentyl-N-ethylamino)-6-methyl-7-anilinofluoran | 20 |
| 10% aqueous solution of polyvinyl alcohol | 10 |
| Water | 70 |

The mixture was dispersed in a sand grinder to such an extent that the resultant dispersed solid particles had an average size of 1 μm or less.

(3) Preparation of an aqueous color-developing agent dispersion B

A mixture was prepared in the following composition.

| Component | Part by weight |
|---|---|
| N-(p-toluenesulfonyl)-N'-phenylurea | 20 |
| 10% aqueous solution of polyvinyl alcohol | 10 |
| Water | 70 |

The mixture was dispersed in a sand grinder to an extent such that the resultant dispersed solid particles had an average size of 1 μm or less.

(4) preparation of an aqueous arylsulfonamide compound dispersion D

| Component | Part by weight |
|---|---|
| 4'-methoxy-p-toluenesulfonanilide | 20 |
| 10% aqueous solution of polyvinyl alcohol | 10 |
| Water | 70 |

The mixture was dispersed in a sand grinder to such an extent that the resultant dispersed solid particles had an average size of 1 μm or less.

(5) Formation of thermosensitive colored image-forming layer

A coating liquid was prepared by mixing 50 parts by weight of the aqueous dye precursor dispersion A and 120 parts by weight of the aqueous color-developing agent dispersion B and 120 parts by weight of the aqueous arylsulfonamide compound dispersion D with 26 parts by weight of a calcium carbonate pigment, 12 parts by weight of a 25% aqueous zinc stearate dispersion, 10 parts by weight of a 30% aqueous paraffin dispersion and 80 parts by weight of a 10% aqueous polyvinyl alcohol solution, by agitating the mixture.

A surface of the pigment-coated paper sheet was coated with the resultant coating liquid and dried. A thermosensitive colored image-forming layer was formed with a weight of 5.0 g/m$^2$.

(6) Calendering treatment

The recording sheet was treated by a super calender, and the calendered surface of the recording sheet had a Bekk smoothness of 600 to 1,000 seconds.

A thermosensitive recording sheet was obtained.

(7) Performance test

Specimens of the resultant thermosensitive recording sheet were subjected to a colored image-developing test by using a dynamic color-developing tester provided by modifying a thermosensitive facsimile printer with an applied energy of 0.39 mj/dot or 0.49 mj/dot.

The resultant colored images were subjected to a measurement of color density by a Macbeth Reflection Color Density Tester RD-914 (trademark). The measured colored density of the colored images on the specimen is referred to as an initial color density ($D_0$) of the colored images.

Also, specimens were heated by a Heat Inclination Tester made by Toyo Seiki K.K., at a temperature of 70° C. under a pressure of 2.5 kg/cm$^2$ for 5 seconds, and the color density of the heat-developed color on the specimens was measured by the above-mentioned color density tester. The color-forming property of the specimens is referred to as a static color-forming performance of the specimens which represents a resistance of the specimens to color-formation at a relatively high temperature.

The test results are shown in Table 4.

EXAMPLE 14

A thermosensitive recording sheet was prepared and tested using the same procedure as in Example 13 except that during the preparation of the aqueous arylsulfonamide compound dispersion D, 4'-methoxy-p-toluenesulfonanilide was replaced by 4'-ethoxy-p-toluenesulfonanilide.

The test results are shown in Table 4.

EXAMPLE 15

A thermosensitive recording sheet was prepared and tested using the same procedure as in Example 13 except that during the preparation of the aqueous arylsulfonamide compound dispersion D, 4'-methoxy-p-toluenesulfonanilide was replaced by 4'-methoxybenzenesulfonanilide.

The test results are shown in Table 4.

EXAMPLE 16

A thermosensitive recording sheet was prepared and tested using the same procedure as in Example 13 except that during the preparation of the aqueous arylsulfonamide compound dispersion D, 4'-methoxy-p-toluenesulfonanilide was replaced by 2'-methoxybenzenesulfonanilide.

The test results are shown in Table 4.

EXAMPLE 17

A thermosensitive recording sheet was prepared and tested using the same procedure as in Example 13 except that during the preparation of the aqueous dye precursor dispersion A, 3-(N-ethyl-N-isopentylamino)-6-methyl-7-anilinofluoran was replaced by 3-dibutylamino-6-methyl-7-anilinofluoran and during the preparation of the aqueous color developing agent dispersion B, N-(p-toluenesulfonyl)-N'-phenylurea was replaced by N-(p-toluenesulfonyl)-N'-(p-methoxyphenyl)urea.

The test results are shown in Table 4.

COMPARATIVE EXAMPLE 5

A thermosensitive recording sheet was prepared and tested using the same procedure as in Example 13 except that in the formation of the thermosensitive colored image-forming layer, the use of the aqueous arylsulfonamide compound dispersion D was omitted.

The test results are shown in Table 4.

COMPARATIVE EXAMPLE 6

A thermosensitive recording sheet was prepared and tested using the same procedure as in Example 13 except that during the preparation of the aqueous color developing agent dispersion B, N-(p-toluenesulfonyl)-N'-phenylurea was replaced by 2,2-bis(4-hydroxyphenyl)propane, namely bisphenol A.

The test results are shown in Table 4.

TABLE 4

| Example No. | | Item: Color density 0.39 mj/dot | Color density 0.49 mj/dot | Static color-forming performance |
|---|---|---|---|---|
| Example | 13 | 1.31 | 1.41 | 0.08 |
| | 14 | 1.30 | 1.39 | 0.09 |
| | 15 | 1.32 | 1.42 | 0.11 |
| | 16 | 1.32 | 1.41 | 0.10 |
| | 17 | 1.33 | 1.43 | 0.10 |
| Comparative | 5 | 0.75 | 1.02 | 0.07 |
| Example | 6 | 1.29 | 1.38 | 0.48 |

Table 4 clearly indicates that when the specific color-developing compound having at least one arylsulfonylureido group of the formula (I) was used as a color developing agent in combination of the thermally fusible arylsulfonamide compound of the formula (III), the resultant thermosensitive colored image-forming layer exhibited a high thermosensitivity comparative to or higher than that produced by using a conventional typical color developing agent consisting of bisphenol A, and a high resistance to undesirable color formation (fogging) at a temperature of 70° C.

EXAMPLE 18

A thermosensitive recording sheet was prepared and tested using the same procedure as in Example 13 except that during the preparation of the aqueous color developing agent dispersion B, N-(p-toluenesulfonyl)-N'-phenylurea was replaced by 4,4'-bis(N'-(p-toluenesulfonyl)ureido)diphenylmethane.

Specimens of the resultant thermosensitive recording sheet were subjected to a colored image-developing test by using a dynamic color-developing tester provided by modifying a thermosensitive facsimile printer with an applied energy of 0.39 mj/dot or 0.49 mj/dot.

The resultant colored images were subjected to a measurement of a color density by a Macbeth Reflection Color Density Tester RD-914 (trademark). The measured colored density of the colored images on the specimen is referred to as an initial color density ($D_0$) of the colored images.

Then, the specimens color-developed with an applied energy of 0.49 mj/dot were subjected to a resistance test to an oil and a plasticizer in the following manner.

Within 30 minutes from the completion of the color-developing operation, colored image-formed surfaces of the specimens were coated with salad oil or dioctyl phthalate (DOP), which is a typical plasticizer, and left to stand at room temperature for 30 minutes. Then, the oil or plasticizer was wiped away from the specimen surfaces, and the color density of the colored images retained on the specimens was measured by a Macbeth Reflection Color Density Tester. The measured color density is referred to as a color density (D) of the oil or plasticizer-treated colored images.

The retention in color density of the colored images was calculated in the above-mentioned manner.

The test results are shown in Table 5.

EXAMPLE 19

A thermosensitive recording sheet was prepared and tested using the same procedure as in Example 18 except that during the preparation of the aqueous arylsulfonamide compound dispersion D, 4'-methoxy-p-toluenesulfonanilide was replaced by 2'-methoxy-5'-methyl-p-toluenesulfonanilide.

The test results are shown in Table 5.

EXAMPLE 20

A thermosensitive recording sheet was prepared and tested using the same procedure as in Example 18 except that during the preparation of the aqueous arylsulfonamide compound dispersion D, 4'-methoxy-p-toluenesulfonanilide was replaced by 4'-ethoxy-p-toluenesulfonanilide.

The test results are shown in Table 5.

EXAMPLE 21

A thermosensitive recording sheet was prepared and tested using the same procedure as in Example 18 except that during the preparation of the aqueous arylsulfonamide compound dispersion D, 4'-methoxy-p-toluenesulfonanilide was replaced by 4'-methoxybenzenesulfonanilide.

The test results are shown in Table 5.

EXAMPLE 22

A thermosensitive recording sheet was prepared and tested using the same procedure as in Example 18 except that during the preparation of the aqueous arylsulfonamide compound dispersion D, 4'-methoxy-p-toluenesulfonamide was replaced by 2'-methoxybenzenesulfonanilide.

The test results are shown in Table 5.

EXAMPLE 23

A thermosensitive recording sheet was prepared and tested using the same procedure as in Example 18 except that during the preparation of the aqueous arylsulfonamide compound dispersion D, 4'-methoxy-p-toluenesulfonanilide was replaced by 2'-methoxy-ptoluenesulfonanilide.

The test results are shown in Table 5.

EXAMPLE 24

A thermosensitive recording sheet was prepared and tested using the same procedure as in Example 18 except that during the preparation of the aqueous dye precursor dispersion A, 3-(N-isopentyl-N-ethylamino)-6-methyl-7-anilinofluoran was replaced by 3-dibutylamino-6-methyl-7-anilinofluoran, and during the preparation of the aqueous color developing agent dispersion B, 4,4'-bis(N'- (p-toluenesulfonyl)ureido)diphenylmethane was replaced by 4,4'-bis(N'-(p-toluenesulfonyl-)ureido)diphenylether.

The test results are shown in Table 5.

EXAMPLE 25

A thermosensitive recording sheet was prepared and tested using the same procedure as in Example 18 except that in the formation of the thermosensitive colored image-forming layer, the composition of the aqueous color developing agent dispersion B was changed to the following composition.

Preparation of Aqueous Color-Developing Agent Dispersion

| Component | Part by weight |
|---|---|
| 4,4'-bis(N'-(p-toluenesulfonyl) ureido)diphenylmethane | 12 |
| N-(p-toluenesulfonyl)-N'-phenylurea | 8 |
| 10% aqueous polyvinyl alcohol solution | 10 |
| Water | 70 |

The mixture was dispersed by using a sand grinder to such an extent that the resultant dispersed solid particles had an average size of 1 μm or less.

The test results are shown in Table 5.

EXAMPLE 26

A thermosensitive recording sheet was prepared and tested using the same procedure as in Example 4 except that in the formation of the thermosensitive colored image-forming layer, the composition of the aqueous color developing agent dispersion B was changed to the following composition.

Preparation of Aqueous Color-Developing Agent Dispersion

| Component | Part by weight |
|---|---|
| 4,4'-bis(N'-(p-toluenesulfonyl) ureido)diphenylmethane | 12 |
| N-(p-toluenesulfonyl)-N'-butylurea | 8 |
| 10% aqueous polyvinyl alcohol solution | 10 |
| Water | 70 |

The mixture was dispersed by using a sand grinder to such an extent that the resultant dispersed solid particles had an average size of 1 μm or less.

The test results are shown in Table 5.

COMPARATIVE EXAMPLE 7

A thermosensitive recording sheet was prepared and tested using the same procedure as in Example 18 except that during the preparation of the aqueous color developing agent dispersion B, 4,4'-bis(N'-(p-toluenesulfonyl)ureido)diphenylmethane was replaced by 2,2-bis(4-hydroxyphenyl)propane (namely bisphenol A).

The test results are shown in Table 5.

TABLE 5

| Example No. | | Item: Color density 0.39 mj/dot | Color density 0.49 mj/dot | Color density retention (%) Salad oil | DOP |
|---|---|---|---|---|---|
| Example | 18 | 1.26 | 1.34 | 100 | 90 |
| | 19 | 1.24 | 1.29 | 99 | 83 |
| | 20 | 1.23 | 1.30 | 98 | 88 |
| | 21 | 1.25 | 1.33 | 100 | 87 |
| | 22 | 1.28 | 1.34 | 100 | 86 |
| | 23 | 1.22 | 1.30 | 98 | 82 |
| | 24 | 1.23 | 1.32 | 97 | 80 |
| | 25 | 1.30 | 1.32 | 93 | 55 |
| | 26 | 1.32 | 1.33 | 95 | 56 |
| Comparative Example 7 | | 1.28 | 1.35 | 20 | 17 |

EXAMPLE 27

A thermosensitive recording sheet was prepared and tested using the same procedure as in Example 18 with the following exceptions.

(1) Formation of a thermosensitive colored image-forming layer

A coating liquid was prepared by evenly mixing parts by weight of the aqueous dye precursor dispersion A of Example 13, 200 parts by weight of the aqueous color developing agent dispersion B of Example 18, and 120 parts by weight of the aqueous arylsulfonamide compound dispersion D of Example 13 with 26 parts by weight of a calcium carbonate pigment, 12 parts by weight of a 25% aqueous zinc stearate dispersion, 14 parts by weight of a styrene-butadiene copolymer latex having a solid content of 50% by weight and 40 parts by weight of a 10% aqueous polyvinyl alcohol solution, while stirring.

A surface of a paper sheet having a basis weight of 50 $g/m^2$ was coated with the resultant coating liquid and dried to form a thermosensitive colored image-forming layer with a dry weight of 7.5 $g/m^2$.

(2) Formation of overcoat layer

A coating liquid for an overcoat layer was prepared by mixing 5 parts by weight of an aqueous dispersion of kaolinire clay having a solid content of 60% by weight, 35 parts by weight of a 10% aqueous polyvinyl alcohol solution, 22 parts by weight of 10% aqueous casein solution, 1 part by weight of a 25% aqueous zinc stearate dispersion, 2 parts by weight of dimethylolurea cross-linking agent and 35 parts by weight of water while stirring. The coating liquid was coated on the thermosensitive colored image-forming layer and dried, to form an overcoat layer having a dry weight of 1.5 $g/m^2$.

(3) Calendering treatment

The recording sheet was treated by a super calender, and the calendered surface of the recording sheet had a Bekk smoothness of 600 to 1000 seconds.

A thermosensitive recording sheet was obtained.

(4) Test

Specimens of the resultant thermosensitive recording sheet were printed with letters and bar codes using a label printer (trademark: DP-110GS, made by Teraoka Seiko K.K.), to print a regular square pattern of 7 mm×7 mm. The color density of the color-formed portions of the specimens was measured by using a Macbeth Reflection Color Density Tester RD-914. By using the recorded bar code patterns, the bar code portion of each specimen was read by a bar code laser checker made by Symbol Technologies Co. The resultant readability (%) was recorded.

Then, the specimens were immersed in dioctyl phthalate (DOP) controlled at a temperature of 20° C. for 24 hours. The specimens were removed from the DOP and the surfaces of the specimens were wiped. The bar code portions of the specimens were subjected to a reading test using the bar code checker and the resultant readability (%) percentage was recorded.

The higher the readability (%) of the bar codes, the higher the clarity of the bar codes.

The test results are shown in Table 6.

COMPARATIVE EXAMPLE 8

A thermosensitive recording sheet was prepared and tested using the same procedure as in Example 27 except that during the preparation of the aqueous color developing agent dispersion B, 4,4'-bis(N'-(p-toluenesulfonyl)ureido)diphenylmethane was replaced by 2,2-bis(4-hydroxyphenyl)propane (namely bisphenol A).

The test results are shown in Table 6.

TABLE 6

| Example No. | Item: Color density | Bar code readability (%) Before immersion in DOP | After immersion in DOP |
|---|---|---|---|
| Example 27 | 1.36 | 100 | 99 |
| Comparative Example 8 | 1.35 | 100 | 0 |

Tables 5 and 6 clearly show that a combination of the conventional typical color-developing agent consisting of bisphenol A with the arylsulfonamide compounds of the formula (III) caused the resultant colored images to exhibit a poor resistance to an oil and plasticizer. Compared with this, the specific combination of the color developing compounds having at least one arylsulfonylureido group of the formula (I) per molecule thereof with the arylsulfonamide compounds of the formula (III) effectively caused the resultant thermosensitive colored image-forming layer to exhibit an enhanced thermosensitivity comparative to or higher than that obtained by the above-mentioned combination, and the resultant colored images to exhibit a significantly enhanced resistance to an oil and plasticizer even immediately after the formation of the colored images.

We claim:

1. A thermosensitive recording material comprising:

a substrate sheet; and a thermosensitive colored image-forming layer formed on a surface of the substrate sheet and comprising a substantially colorless dye precursor, a color developing agent reactive with the dye precursor upon heating to thereby develop a color, and a binder, said color developing agent comprising at least one compound comprising, per molecule thereof, at least one arylsulfonylureido group of the formula (I):

$$(R-SO_2-\underset{\underset{O}{\|}}{NHCNH}\rightarrow \qquad (I)$$

wherein R represents a member selected from the group consisting of unsubstituted aromatic groups and substituted aromatic groups having at least one substituent selected from the group consisting of lower alkyl groups, lower alkoxyl groups and halogen atoms, and said thermosensitive colored image-forming layer further comprising a thermally fusible additive comprising at least one compound selected from the group consisting of:

(1) acetoacetanilide compounds of the formula (II):

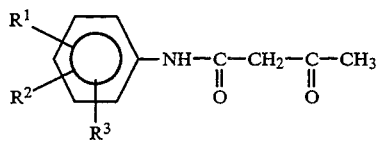

(II)

wherein $R^1$, $R^2$ and $R^3$ respectively and independently from each other represent a member selected from the group consisting of alkyl groups, alkoxyl groups, aralkyl groups, aryl groups, aryloxy groups, nitro group, acetylamino group, acetoacetylamino group, hydrogen atom and halogen atoms; and (2) sulfonamide compounds of the formula (III):

$$Ar_1—SO_2NH—Ar_2 \quad (III)$$

wherein $Ar_1$ and $Ar_2$ respectively and independently from each other represent a member selected from the group consisting of unsubstituted phenyl and naphthyl groups, and substituted phenyl and naphthyl groups each having 1 to 3 substituents selected from the group consisting of aryl groups, alkyl groups, alkoxyl groups, nitro group, halogen atoms, alkylamino groups, allyloxy group, aryloxy groups, and aralkyloxy groups, and one of $Ar_1$ and $Ar_2$ has at least one substituent selected from the group consisting of alkoxyl groups, allyloxy group, phenoxy group and benzyloxy group.

2. The thermosensitive recording material as claimed in claim 1, wherein the compound comprising the arylsulfonylureido group of the formula (I) is selected from the group consisting of:

N-(p-toluenesulfonyl )-N'-phenylurea,
N-(p-toluenesulfonyl )-N'-(p-methoxyphenyl)urea,
N-(p-toluenesulfonyl )-N'-(o-tolyl)urea,
N-(p-toluenesulfonyl )-N'-(m-tolyl)urea,
N-(p-toluenesulfonyl )-N'-(p-tolyl)urea,
N-(p-toluenesulfonyl )-N'-(p-n-butylphenyl)urea,
N-(p-toluenesulfonyl )-N'-(o-chlorophenyl)urea,
N-(p-toluenesulfonyl )-N'-(m-chlorophenyl)urea,
N-(p-toluenesulfonyl )-N'-(2,4-dichlorophenyl)urea,
N-(p-toluenesul fonyl )-N'-benzylurea,
N-(p-toluenesulfonyl )-N'-(1-naphthyl)urea,
N-(p-toluenesulfonyl )-N'-(1-(2-methylnaphthyl)-)urea,
N-(benzenesulfonyl)-N'-phenylurea,
N-(p-chlorobenzenesul fonyl)-N'-phenylurea,
N-(o-toluenesulfonyl)-N'-phenylurea,
N-(p-toluenesulfonyl)-N'-methylurea,
N-(p-toluenesulfonyl)-N'-ethylurea,
N-(p-toluenesulfonyl)-N'-(2-phenoxyethyl)urea,
N,N'-bis(p-toluenesulfonyl)urea,
N-(p-toluenesulfonyl)-N'-(o-diphenyl)urea,
N-(p-toluenesulfonyl)-N'-(p-ethoxycarbonylphenyl-)urea,
N-(p-toluenesulfonyl)-N'-butylurea,
N-(p-chlorobenzenesulfonyl)-N'-propylurea,
N-(p-methoxybenzenesulfonyl)-N'-phenylurea,
bis((p-toluenesulfonyl)ureido)ketone,
1,2-bis(N'-(p-toluenesulfonyl)ureido)ethane,
1,1,6,6,-tetra(N'-(p-toluenesulfonyl)ureido)heptane,
1,5-bis(N'-(p-toluenesulfonyl)ureido)-3-oxapentane,
1,5-bis(N'-(p-toluenesulfonyl)ureido)-3-thiopentane,
1,3-bis(N'-(p-toluenesulfonyl)ureido)-2-propane,
1,5-bis(N'-(p-toluenesulfonyl)ureido)-3-(2'-(N'-(p-toluenesulfonyl)ureido)ethyl)-3-azapentane,
4,4'-bis(N'-(p-toluenesulfonyl)ureido)-diphenylmethane,
4,4'-bis(N'-(o-toluenesulfonyl)ureido)-diphenylmethane,
4,4'-bis(benzenesulfonylureido)-diphenylmethane,
4,4'-bis(1-naphthalenesulfonylureido)-diphenylmethane,
2,2-bis(4',4''-(N'-(p-toluenesulfonyl)ureido)-phenyl)-propane,
1,2-bis(4'-(N'-(p-toluenesulfonyl)ureido)-phenyloxy)ethane,
2,5-bis((N'-(p-toluenesulfonyl)ureido)methyl)-furan,
1,3-bis(N'-(p-toluenesulfonyl)ureido)benzene,
1,4-bis(N'-(p-toluenesulfonyl)ureido)benzene,
1,5-bis(N'-(p-toluenesulfonyl)ureido)-naphthalene,
1,8-bis(N'-(p-toluenesulfonyl)ureido)-naphthalene,
4,4'-bis(N'-(p-toluenesulfonyl)ureido)-diphenylether,
3,3'-bis(N'-(p-toluenesulfonyl)ureido)-diphenylsulfone,
4,4'-bis(N'-(p-toluenesulfonyl)ureido)-diphenylsulfone,
2,4-bis(N'-(p-toluenesulfonyl)ureido)-toluene,
2,6-bis(N'-(p-toluenesulfonyl)ureido)-toluene,
4,4'-bis(N'-(p-toluenesulfonyl)ureido)-diphenylsulfide, and
3,4'-bis(N'-(p-toluenesulfonyl)ureido)-diphenylether.

3. The thermosensitive recording material as claimed in claim 1, wherein the acetoacetanilide compound of the formula (II) is selected from the group consisting of:

p-chloroacetoacetanilide,
o-chloroacetoacetanilide,
acetoacetanilide,
o-methylacetoacetanilide,
p-methylacetoacetanilide,
o-methoxyacetoacetanilide,
p-methoxyacetoacetanilide,
p-ethoxyacetoacetanilide,
p-acetylaminoacetoacetanilide,
2,4-dimethylacetoacetanilide,
5-chloro-2-methoxyacetoacetanilide,
2,4-dimethoxyacetoacetanilide,
2,5-dimethoxyacetoacetanilide,
4-chloro-2,5-dimethoxyacetoacetanilide,
o-nitroacetoacetanilide,
m-nitroacetoacetanilide,
p-nitroacetoacetanilide,
2-methoxy-5-methylacetoacetanilide,
2-methoxy-4-nitroacetoacetanilide,
2,5-dichloroacetoacetanilide,
1,3-bis(acetoacetylamino)benzene,
1,4-bis(acetoacetylamino)benzene,
o-ethylacetoacetanilide,
2-chloro-4-methylacetoacetanilide,
4-methoxy-2-nitroacetoacetanilide,
2,4-dimethoxy-5-chloroacetoacetanilide,
2,5-diethoxy-4-chloroacetoacetanilide, and
o-ethoxyacetoacetanilide.

4. The thermosensitive recording material as claimed in claim 1, wherein the arylsulfonamide compound of the formula (III) is selected from the group consisting of:

4'-methoxy-p-toluenesulfonanilide,
2'-methoxy-p-toluenesulfonanilide,
4'-ethoxy-p-toluenesulfonanilide,
2'-ethoxy-p-toluenesulfonanilide,
4'-methoxy-benzenesulfonanilide,
3'-methoxy-benzenesulfonanilide,
2'-methoxy-benzenesulfonanilide,
4'-ethoxy-benzenesulfonanilide,
2'-ethoxy-benzenesulfonanilide,
4'-methoxy-p-chlorobenzenesulfonanilide,
2'-methoxy-p-chlorobenzenesulfonanilide,
4'-ethoxy-p-chlorobenzenesulfonanilide,
4'-methoxy-p-bromobenzenesulfonanilide,
4'-methoxy-p-ethylbenzenesulfonanilide,
2'-methoxy-p-ethylbenzenesulfonanilide,
4'-methoxy-2,5-dimethylbenzenesulfonanilide,
4'-methoxy-naphthalene-2-sulfonanilide,
4'-methoxy-naphthalene-1-sulfonanilide,
2'-methoxy-naphthalene-2-sulfonanilide,
2'-allyloxy-p-toluenesulfonanilide,
2'-n-propoxy-p-toluenesulfonanilide,
2'-n-butoxy-p-toluenesulfonanilide,
4'-methoxy-o-toluenesulfonanilide,
2'-methoxy-o-toluenesulfonanilide,
4'-ethoxy-o-toluenesulfonanilide,
2'-ethoxy-o-toluenesulfonanilide,
2'-methoxy-5'-chloro-p-toluenesulfonanilide,
2',5'-dimethoxy-4'-chloro-benzenesulfonanilide,
2',5'-dimethoxy-benzenesulfonanilide,
2',4'-dimethoxy-benzenesulfonanilide,
3',5'-dimethoxy-benzenesulfonanilide,
4'-nitro-2'-methoxy-benzenesulfonanilide,
5'-nitro-2'-methoxy-benzenesulfonanilide,
2'-nitro-4'-methoxy-benzenesulfonanilide,
3',4',5'-trimethoxy-benzenesulfonanilide,
4'-chloro-2'-methoxy-5'-methyl-benzenesulfonanilide,
2'-methoxy-5'-methyl-benzenesulfonanilide,
4'-nitro-2'-methoxy-5'-methyl-benzenesulfonanilide,
4'-nitro-2'-ethoxy-5'-methyl-benzenesulfonanilide,
4-methoxybenzenesulfonanilide,
4'-methoxy-p-toluenesulfonanilide,
2-methoxybenzenesulfonanilide,
4-ethoxybenzenesulfonanilide,
2-ethoxybenzensulfonanilide,
3,4-dimethoxybenzenesulfonanilide,
6'-methoxy-2'-nitro-m-toluenesulfonanilide,
p-toluenesulfonyl-N-4-(methoxy-2-naphthyl)amide,
4,4'-dimethoxy-benzenesulfonanilide,
4-methoxy-4'-methyl-benzenesulfonanilide,
2'-benzyloxy-p-toluenesulfonanilide,
3'-benzyloxy-p-toluenesulfonanilide,
2'-phenoxy-p-toluenesulfonanilide,
4'-phenoxy-p-toluenesulfonanilide,
4'-phenyl-4-methoxybenzenesulfonanilide, and
4'-dimethylamino-4-methoxybenzenesulfonanilide.

5. The thermosensitive recording material as claimed in claim 1, wherein the acetoacetanilide compound of the formula (II) and the sulfonamide compound of the formula (III) have a melting temperature of 60° C. to 180° C.

6. The thermosensitive recording material as claimed in claim 1, wherein the color-developing compound having at least one arylsulfonylureido group is present in an amount of 5 to 50% based on the dry weight of the thermosensitive colored image-forming layer.

7. The thermosensitive recording material as claimed in claim 1, wherein the thermally fusible additive is present in an amount of 5 to 50% based on the dry weight of the thermosensitive colored image-forming layer.

* * * * *